United States Patent [19]

Beltzer et al.

[11] Patent Number: 4,840,741

[45] Date of Patent: Jun. 20, 1989

[54] ASHLESS ANTI-WEAR ADDITIVES

[75] Inventors: Morton Beltzer, Westfield, N.J.; Said Jahanmir, Germantown, Md.

[73] Assignee: Exxon Research and Engineering Company, Florham Park, N.J.

[21] Appl. No.: 85,799

[22] Filed: Aug. 17, 1987

Related U.S. Application Data

[63] Continuation of Ser. No. 851,961, Apr. 14, 1986, abandoned.

[51] Int. Cl.[4] ..... C10M 133/40

[52] U.S. Cl. ..... 252/47; 252/47.5; 252/50

[58] Field of Search ..... 252/47, 47.5, 50

*Primary Examiner*—Jacqueline V. Howard
*Attorney, Agent, or Firm*—Joseph J. Dvorak

[57] ABSTRACT

An anti-wear additive for a functional fluid, such as a lube oil, is disclosed. The additive comprises selected substituted pyridines, pyrimidines, pyrazines, pyridazines and/or fused ring derivatives thereof.

8 Claims, No Drawings

ASHLESS ANTI-WEAR ADDITIVES

This is a continuation of application Ser. No. 851,961, filed 4/14/86, now abandoned.

BACKGROUND OF THE INVENTION

The present invention is directed at an additive for a functional fluid. More specifically, the present invention is directed at an ashless anti-wear additive for lube oil.

Several factors are combining to increase the demands on the wear protection capability of passenger car engine oils. In the formulation of lube oils, an anti-wear additive frequently is added to decrease the wear associated with operation. In lube oils for internal combustion engines, the anti-wear additive often comprises a phosphorus compound, such as zinc dialkyldithiophosphate. While this additive has proven effective in reducing engine wear, the phosphorus present has been determined to be a catalyst poison, when minor amounts of the lube oil are combusted in the internal combustion engine.

In addition, the severe operating conditions of high speed engines and the use of fast burn engines with higher combustion temperatures increase the oil sump temperature. Moreover, engine manufacturers are recommending lower viscosity oil, such as 5W30 for faster cold starting and improved fuel economy.

U.S. Pat. No. 3,374,173 discloses 2,4,6 tri-amino substituted pyrimidines are effective in imparting high temperature stability to lubricants. In a preferred embodiment the tri-amino substituted pyrimidine is prepared from a 2,4,6 trichloropyrimidine.

Japanese Patent Publication No. 58,103,594 discloses the addition of a substituted benzothiazole as an anti-wear additive for a lubricating oil used in freon compressors.

In "Boundary Lubricating Studies Structure-Activity Correlations in Alkylpyridines", Journal of the Institute of Petroleum, Volume 59, Number 565 (January, 1973), A. H. Miller discloses that pyridine, benzopyridine and certain alkylpyridines are effective as anti-wear agents in lube oils.

U.S. Pat. No. 4,113,725 discloses compounds of the general formula:

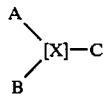

in which X is a heterocyclic radical derived from pyridine, pyridazine, pyrimidine, pyrazine or triazine; and A, B and C are each hydrogen, alkyl, aralkyl, alkenyl, aryl, alkaryl, hydroxyalkyl, hydroxyaryl, carboxy, alkylcarboxy, hydroxy, phosphono, phosphato, sulfonato, mercapto or a nitrogen-containing substituent having from about 1 to about 500 atoms, preferably from about 1 to 100 carbon atoms, provided that at least one of A, B, or C is one of the nitrogen-containing substituents. The nitrogen-containing substituents include alkyl-amino, arylamino, succinimide amino, lactam amino and the like.

Accordingly, it would be desirable to provide a phosphorus-free anti-wear additive for a functional fluid, such as a lube oil.

It also is advantageous to provide anti-wear additive for a lube oil which is soluble in the lube oil and which is effective at relatively low concentrations. It also would be desirable to provide an ashless anti-wear additive to minimize depositions on catalytic converters.

The present invention is directed at an additive for a functional fluid, such as a lube oil comprising:

A. a basestock; and

B. an anti-wear compound selected from the group consisting of substituted pyridine, pyrimidine, pyrazine, pyridazine, fused ring derivatives thereof and mixtures thereof.

SUMMARY OF THE INVENTION

The present invention is directed at a functional fluid having improved anti-wear properties, said functional fluid comprising:

A. a basestock; and,

B. an anti-wear compound selected from the group consisting of:

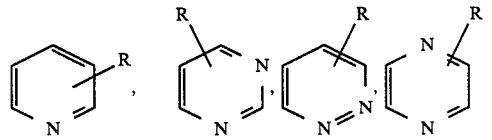

fused ring derivatives thereof and mixtures thereof, where R may be a single or multiple substituent. R preferably is selected from the group consisting of halogens, chloromethyl, dichloromethyl, trichloro-methyl, chlorobromomethyl, bromomethyl, dibromomethyl, cyano, isocyano, methylcyano, cyanomethyl, cyanate, isocyanate, thiocyanate, isothiocyanate, nitro, nitromethyl, nitroso, formyl, acetyl, methyl carboxylate, methoxy, methylthio, thiol, disulfide.

When the anti-wear compound comprises substituted pyridine,

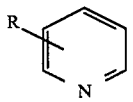

the substituent preferably has a bond moment of at least 1.42 Debyes if it is in the metal position and 3.9 Debyes in the ortho position. Preferred compounds comprise meta substituted compounds. When the anti-wear compound comprises a fused ring derivative of pyridine, such as quinoline, R may have a bond or group moment of 1.25 Debyes. Where the anti-wear compound comprises substituted pyrimidine

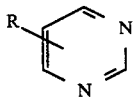

or substituted pyridazine

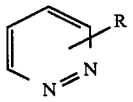

preferred substituents also have a dipole moment of 1.4 and 0.97 Debyes, respectfully. When the anti-wear compound comprises substituted pyrazine,

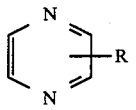

preferably has a dipole moment of at least 1.4 Debyes. For all of the above-noted compounds, preferred substituents are selected from the group consisting of —Cl, —Br, —$CH_2Cl$, —$CH_2ClBr$, —$CHCl_2$, —$CH_2Br$, —$CHBr_2$, —CN, $CH_2CN$, —NC, —CNO, —NCO, —SCN, —NCS, -$NO_2$, —$CH_2NO_2$, —NO, —CHO, —$COCH_3$, $OCH_3$, —$COOCH_3$, —$CCl_3$, —$S_2$—, —$SCH_3$, SH, and mixtures thereof.

In a preferred embodiment the functional fluid comprises a lube oil. The additive preferably comprises from about 0.25 weight percent to about 2.0 weight percent of the lube oil, preferably from about 0.5 weight percent to about 1.5 weight percent of the lube oil.

The present invention also is directed at a method for decreasing wear in an internal combustion engine having lubricant circulated therethrough, said method comprising adding to the lubricant an effective amount of an anti-wear additive having the general formula:

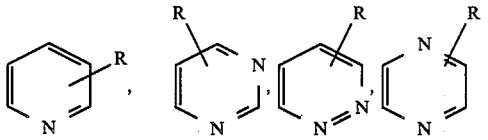

fused ring derivatives thereof and mixtures thereof, having a substituent selected from the group consisting of —Cl, —Br, —$CH_2Cl$, —$CH_2ClBr$, —$CHCl_2$, —$CHBr_2$, —CN, $CH_2CN$, —NC, —CNO, —NCO, —SCN, —NCS, —SCN, —$NO_2$, —$CH_2NO_2$, —NO, —CHO, —$COCH_3$, $OCH_3$, —$COOCH_3$, —$CCl_3$, —$S_2$—, $SCH_3$, SH, and mixtures thereof.

DETAILED DESCRIPTION OF THE INVENTION

The present invention is directed at an anti-wear additive for a functional fluid, such as a lube oil, said additive comprising:

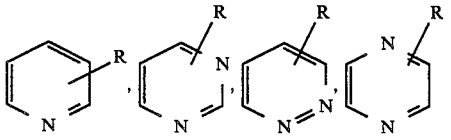

fused ring derivatives thereof and mixtures thereof, where R may be a single or multiple substitute forming a dipole moment of at least 1.42 Debyes for pyridine, 0.97 Debyes for pyridazine, and 1.42 Debyes for pyrazine and pyrimidine. R preferably is selected from the group consisting of halogens, chloromethyl, dichloromethyl, trichloromethyl, chlorobromomethyl, bromomethyl, dibromomethyl, cyano, isocyano, methylcyano, cyanomethyl, cyanate, isocyanate, thiocyanate, isothiocyanate, nitro, nitromethyl, nitroso, formyl, acetyl, methyl carboxylate, methoxy, methylthio, thiol, disulfide.

Preferred halogen substituents include chlorine and bromine.

Four Ball Wear tests were conducted to determine the effectiveness of various additives in reducing wear. This test is described in detail in ASTM method D-2266, the disclosure of which is incorporated herein by reference. In this test three balls are fixed in a lubricating cup and an upper rotating ball is pressed against the lower three balls. The test balls utilized in the following tests were made of AISI 52100 steel with a hardness of 65 Rockwell C (840 Vickers) and a centerline roughness of 25 nm. Prior to the tests, the test cup, steel balls and all holders were degreased with 1,1,1 trichlorethane. The steel balls subsequently were washed with a laboratory detergent to remove any solvent residue, rinsed with water, and dried under nitrogen.

The base lubricant utilized in all of the foregoing tests was 150 Neutral, a solvent extracted, dewaxed hydrofined neutral basestock having a viscosity of 32 centistokes (150 SSU) at 40° C. In the following tables, results are shown for Four Ball Wear tests conducted at room temperature, at 60 kg load, 1200 rpm for 45 minutes duration utilizing 1 weight percent of each additive.

After the wear tests, the balls were degreased and the wear scar diameter on the lower balls measured using an optical microscope. The average of at least two measurements was used in calculating the wear volume per ball. The calculated wear volume was based on the assumption that the worn volume is a circular sector.

The Four Ball Wear test results are presented in terms of wear volume and on the relative basis of percent wear reduction. The latter is based on the minimum wear volume of 0.054 $mm^3$ observed using 150 neutral basestock without any anti-wear additive, although wear volumes in replicate tests in base lubricant varied widely and often exceed this value.

As shown in Tables I to X hereinafter, it has been found that substituted pyridines, pyrimidines, pyrazines, pyridazines, quinolines, and mixtures thereof were effective anti-wear additives. The above-noted classes of compounds preferably include electronegative substituents. As used herein, the term electronegative substituent is defined to mean one which attracts electrons. Where the anti-wear additive comprises pyridine, the electronegative substituent preferably has a dipole moment greater than about 1.42 Debyes. For compounds having more than one nitrogen in the ring, such as pyridazine and pyrimidine weaker electronegative substituent groups may be utilized, such as substituent groups having dipole moments greater than about 1.25 Debyes. For pyridazines still weaker electronegative substituents having a dipole moment of greater than 0.97 Debyes may be used. Among the preferred substituent groups are the halogens, methyl substituted halogens, cyano-substituents, alkoxy substituents, nitroso and dithio substituents. Among the preferred halogens are chlorine and bromine. Among the preferred methyl substituted halogens are chloromethyl, dichloromethyl, trichloromethyl, bromomethyl, chlorobromomethyl, dibromomethyl and mixtures thereof. Among the preferred cyano-substituents are cyano, isocyano, isocyanato, thiocyanato. Among the preferred nitrogen containing substituents are nitro, nitromethyl, nitroso, and mixtures thereof. Among the preferred alkoxy compounds are formyl-, acetyl-, methoxy and methylcarboxylate. Other preferred substituents include methyl thio, methyl thiol, disulfide and mixtures thereof.

A. Substituted Pyridines

When the pyridine substituted compounds,

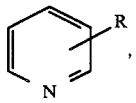

are utilized the substituent compound preferably has a bond or group dipole moment of at least 3.9 Debyes if it is in the ortho position and 1.42 Debyes if it is in the meta position. R preferably is selected from the group consisting of —Cl, —Br, $CH_2Cl$, —$CHCl_2$, —$CCl_2$, —$CCl_3$, —$CH_2Br$, —$CHBr_2$, —CN, —$CH_2CN$, —NC, —CNO, —NCO, —SCN, —NCS, —$NO_2$, —$CH_2NO_2$, —CHO, —$COCH_3$, —$OCH_3$, —$COOCH_3$, —$S_2$, —$SCH_3$, —SH and mixtures thereof.

In Table I the additives noted were added to 150 Neutral basestock without any additional components normally found in a fully formulated lube oil.

Also shown in Table I for comparative purposes is the wear volume obtained with zinc dialkyl-dithiophosphate, which reduces wear by about 98.9%. For a heterocyclic additive to be seriously considered as an effective anti-wear agent, it is believed that the test results should show wear reductions of at least 95% as compared to the basestock with no anti-wear additive.

In Table II Four Ball Wear Test data conducted at 100° C., ambient air, 60 kg load, 1200 rpm for 45 minutes duration is shown for partially formulated lube oils. The lube oil contained all conventional additives except for ZDDP and a conventional friction reducing additive which also serves as an anti-wear agent. The other additives present in a conventional lube oil also may impart some anti-wear properties. This may be seen from the base case in Table II where the wear volume was 0.029 $mm^3$ with no anti-wear additive, 46% less than the 0.054 $mm^3$ wear volume reported in Table I for the basestock alone.

TABLE I

PYRIDINE AND PYRIDINE DERIVATIVES AS ANTI-WEAR AGENTS IN BASESTOCK

| Additive | Wear Volume $mm^3$ | % Wear Reduction |
|---|---|---|
| None | 0.054 | 0.0 |
| ZDDP | 0.0004 | 99.2 |
| Pyridine | 0.054 | — |
| 2-(Aminomethyl Pyridine | 0.0004 | 99.2 |
| 2-(p-nitrobenzyl) Pyridine | 0.0044 | 91.4 |
| 2,4'-Dipyridyl | 0.0061 | 88.0 |
| 2-(2-Aminoethyl Pyridine) | 0.0008 | 98.4 |

TABLE I-continued

PYRIDINE AND PYRIDINE DERIVATIVES AS ANTI-WEAR AGENTS IN BASESTOCK

| Additive | Wear Volume $mm^3$ | % Wear Reduction |
|---|---|---|
| 2-Chloro-3,5-Dinitropyridine | 0.0057 | 88.8 |
| 3-Chloropyridine | 0.0008 | 98.4 |
| 2,6-Diacetylpyridine | 0.0040 | 92.2 |
| Di-2-Pyridyl Ketone | 0.0021 | 95.9 |
| 2,3-Cycloheptenopyridine | 0.0025 | 95.1 |
| 2,2'-Dithiodipyridine | 0.0007 | 98.6 |
| 4,4'-Dithiodipyridine | 0.0010 | 98.0 |
| 3-Bromopyridine | 0.0013 | 97.5 |
| 2-(3-Thienyl) Pyridine | 0.0038 | 92.5 |
| 2,3'-Dipyridyl | 0.0038 | 92.5 |
| 3-Pyridine Carboxyaldehyde | 0.0052 | 89.8 |

As shown in Table I, the substituted pyridines exhibited substantially superior % wear reduction than unsubstituted pyridine. The utility of the present invention also may be seen from Table II in which certain of the additives from Table I also were utilized in a partially formulated lubricating oil. In one series of tests, the anti-wear additives, zinc dialkyldithiophosphate and another conventional friction reducing additive both were eliminated from the otherwise complete formulated lube oil. In their place the indicated pyridine additives were added at the 1.0 weight percent level. It can be seen that the pyridine compounds effectively reduced wear in Four Ball Wear Tests conducted at 100° C., 60 kg load, 1200 rpm for 45 minutes test duration. Additional Four Ball Wear Tests were conducted in oil formulations similar to that previously noted in which the pyridine compound and ZDDP both were added, but in which the other conventional friction additive was not utilized. These test results indicate that use of ZDDP and the pyridine compound generally produced better wear reduction than either ZDDP or the pyridine additive individually.

TABLE II

WEAR REDUCTION UTILIZING PYRIDINE-CONTAINING COMPOUNDS

| | Partially Formulated Lube Oil | | | |
|---|---|---|---|---|
| | W/O ZDDP or Conventional Friction Reducing Additive | | With ZDDP, But W/O Conventional Friction Reducing Additive | |
| Additive in Partially Formulated Lube Oil | Wear Volume $mm^3$ | % Wear Reduction | Wear Volume $mm^3$ | % Wear Reduction |
| None | 0.0293 | 0.00 | 0.0019 | 93.5 |
| 2-3-Cycloheptenopyridine | 0.0019 | 93.5 | 0.0016 | 94.5 |
| 2-Aminomethylpyridine | 0.0020 | 93.2 | *— | — |
| 2-Chloro-3,5 Dinitropyridine | 0.0013 | 95.6 | 0.001 | 96.6 |
| 4,4'-Dithiodipyridine | 0.0015 | 94.9 | 0.0012 | 95.9 |
| 2,2'-Dithiodipyridine | 0.0018 | 93.9 | 0.0021 | 92.8 |
| 3-Bromopyridine | 0.0021 | 92.8 | 0.0016 | 94.5 |

*Incompatible with ZDDP

B. Substituted Pyrimidines

When pyrimidine substituted compounds are utilized

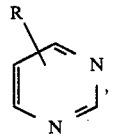

the substituent preferably has a bond or group moment of at least 1.4 Debyes. R preferably is selected from the group consisting of chlorine, bromine, chloromethyl, dichloromethyl and mixtures thereof.

Tests similar to those conducted with the pyridine additives were conducted utilizing certain pyrimidine compounds. The test results presented in Tables III and IV utilized the same additive concentrations and test conditions as those presented in Tables I and II, respectively. Here also it may be seen that the pyrimidine compounds listed were effective in reducing wear, and that the combination of ZDDP and the pyrimidine additive generally reduced the wear below that achieved using only ZDDP. As shown in Table III, substituted pyrimidine compounds exhibited superior wear reduction capabilities than pyrimidine.

TABLE III

PYRIMIDINE COMPOUNDS AS ANTI-WEAR AGENTS IN BASESTOCK

| Additive | Wear Volume $mm^3$ | % Wear Reduction |
|---|---|---|
| Pyrimidine* (3 wt. %) | 0.0013 | 97.6 |
| 4-6-Dichloro-2-Methyl Thiopyrimidine | 0.0002 | 99.6 |
| 5-Bromopyrimidine | 0.0003 | 99.4 |
| tert-Butyl S—(4,6-Dimethyl Pyrimidinyl-2) Thiol Carbonate | 0.0027 | 94.7 |
| 2,4,6-Trichloropyrimidine | 0.0008 | 98.4 |
| ZDDP | 0.0004 | 99.2 |

*Not effective at 1 wt. %

TABLE IV

WEAR REDUCTION UTILIZING PYRIMIDINE-CONTAINING COMPOUNDS

| | Partially Formulated Lube Oil | | | |
|---|---|---|---|---|
| | W/O ZDDP W/O Conventional Friction Reducing Additive | | With ZDDP, But W/O Conventional Friction Reducing Additive | |
| Additive in Partially Formulated Lube Oil | Wear Volume $mm^3$ | % Wear Reduction | Wear Volume $mm^3$ | % Wear Reduction |
| None | 0.0293 | 0.00 | 0.0019 | 93.5 |
| 4,6-Dichloro-2 Methyl Thio Pyrimidine | 0.0014 | 95.2 | 0.0004 | 98.6 |
| 2,4,6-Trichloropyrimidine | 0.0023 | 92.2 | 0.0003 | 99.0 |

C. Substituted Pyrazines

When pyrazine substituted compounds, are utilized

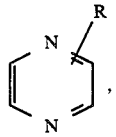

the substituent preferably forms a dipole moment of at least 1.42 Debyes. R preferably is selected from the group consisting of chlorine, bromine and mixtures thereof.

Four Ball Wear Tests also were conducted utilizing pyrazine additives. The test results, presented in Tables V and VI also utilized the same additive concentrations and test conditions as those conducted for the results presented in Tables I and II, respectively. Here also, substituted pyrazine compounds exhibited superior wear reducing and friction reducing properties to pyrazine.

TABLE V

PYRAZINE COMPOUNDS AS ANTI-WEAR AGENTS IN BASESTOCK

| Additive | Wear Volume $mm^3$ | % Wear Reduction |
|---|---|---|
| Pyrazine | 0.035 | 35.1 |
| 2-Methyl-6-Propoxypyrazine | 0.0028 | 94.5 |
| 2-Sec-Butyl-3-Methoxypyrazine | 0.0036 | 92.9 |
| 3-Chloro-2,5-Dimethylpyrazine | 0.0004 | 99.2 |

TABLE VI

WEAR REDUCTION UTILIZING PYRAZINE-CONTAINING COMPOUNDS

| | Partially Formulated Lube Oil | | | |
|---|---|---|---|---|
| | W/O ZDDP or Conventional Friction Reducing Additive | | With ZDDP, But W/O Conventional Friction Reducing Additive | |
| Additive in Partially Formulated Lube Oil | Wear Volume $mm^3$ | % Wear Reduction | Wear Volume $mm^3$ | % Wear Reduction |
| None | 0.0029 | 0.00 | 0.0019 | 93.5 |
| 2-Sec-Butyl-3-Methoxy Pyrazine | 0.0021 | 92.8 | 0.0015 | 94.9 |
| 3-Chloro-2,5-Dimethyl Pyrazine | 0.0031 | 89.4 | 0.0034 | 88.4 |

D. Substituted Pyridazines

When pyridazine substituted compounds are utilized,

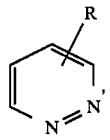

the substituent compound preferably has a bond or group moment of at least 0.97 Debyes. R preferably is selected from the group consisting of chlorine, bromine, chloromethyl, dichloromethyl, trichloromethyl, bromomethyl, dibromomethyl, cyano, isocyano, cyanato, isocyanato, isothiocyanato, thiocyanato, nitro, nitromethyl, nitroso, formyl, acetyl, methylcarboxylate, methoxy, methyl thio, thiol, disulfide and mixtures thereof.

The utility of pyridazine compounds as antiwear agents may be seen from the data presented in Tables VII and VIII below. The test results presented in Tables VII and VIII utilized the same additive concentrations and test conditions as those previously described for the results presented in Tables I and II, respectively. It was not possible to obtain wear reduction results for unsubstituted pyridazine, since this compound was insoluble in the basestock.

TABLE VII

PYRIDAZINE COMPOUNDS AS ANTI-WEAR AGENTS

| Additive | Wear Volume $mm^3$ | % Wear Reduction |
|---|---|---|
| None | 0.051 | 0.0 |
| Pyridazine* | — | — |
| 3,4,5-trichloropyridazine | 0.0005 | 99.0 |
| 3,6-Dichloropyridazine | 0.0008 | 98.5 |

*Insoluble

TABLE VIII

WEAR REDUCTION UTILIZING PYRIDAZINE-CONTAINING COMPOUNDS

| | Partially Formulated Lube Oil | | | |
|---|---|---|---|---|
| | W/O ZDDP and W/O Conventional Friction Reducing Additive | | With ZDDP, But W/O Conventional Friction Reducing Additive | |
| Additive in Partially Formulated Lube Oil | Wear Volume $mm^3$ | % Wear Reduction | Wear Volume $mm^3$ | % Wear Reduction |
| 3,4,5 Trichloropyridazine | 0.0034 | 88.4 | 0.0012 | 95.9 |
| 3,6-Dichloropyridazine | 0.0034 | 88.4 | 0.0026 | 91.3 |

F. Fused Ring Substituted Pyridines

Fused ring derivatives of pyridines, such as quinoline

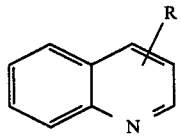

substituted compounds, may be useful as anti-wear agents. The substituent preferably has a dipole moment of 1.25 Debyes or greater and preferably is selected from the group consisting of chlorine, bromine, chloromethyl, dichloromethyl, trichloromethyl, bromomethyl, dibromomethyl, cycano, cyanomethyl, isocyano, isocyanato, cyanato, isocyanato, thiocyanato, isothiocyanato, nitro, nitromethyl, nitroso, formyl, acetyl, methyl carboxylate, methoxy, acetyl, disulfide, methyl thio, thiol and mixtures thereof. The utility of quinoline compounds as anti-wear agents may be seen from the data presented below in Tables IX and X. The test results presented in these tables were obtained using the same additive concentrations and test conditions as those previously described with respect to Tables I and II, respectively.

TABLE IX

QUINOLINE COMPOUNDS AS ANTI-WEAR AGENTS IN BASESTOCK

| Additive | Wear Volume $mm^3$ | % Wear Reduction |
|---|---|---|
| Quinoline (3 wt. %) | 0.0028 | 94.8 |
| 4-Bromoisoquinoline | 0.0011 | 98.0 |
| 6-Methoxyquinoline | 0.0007 | 98.7 |
| 4-Chloro-7(trifluoromethyl-quinoline | 0.0018 | 96.7 |
| 5-Nitroquinoline | 0.0033 | 93.9 |

TABLE X

WEAR REDUCTION UTILIZING QUINOLINE-CONTAINING COMPOUNDS

| | Partially Formulated Lube Oil | | | |
|---|---|---|---|---|
| | W/O ZDDP and W/O Ester Additive | | With ZDDP, But W/O Conventional Friction Reducing Additive | |
| Additive in Partially Formulated Lube Oil | Wear Volume $mm^3$ | % Wear Reduction | Wear Volume $mm^3$ | % Wear Reduction |
| Quinoline | 0.022 | 24.9 | 0.0009 | 96.9 |
| 4-Bromoisoquinoline | 0.0018 | 93.9 | 0.0012 | 95.9 |
| 6-Methoxyquinoline | 0.0017 | 94.2 | 0.0012 | 95.9 |
| 5-Nitroquinoline | 0.0045 | 84.6 | 0.0014 | 95.2 |
| 4-Chloro-7 [Trifluoromethyl]quinoline | 0.0015 | 94.9 | 0.0019 | 96.9 |

What is claimed is:

1. A method for producing a lubricating oil having improved anti-wear properties, said method comprising admixing with a major amount of a basestock of lubricating viscosity from about 0.25 to about 2.0 weight percent of a compound selected from the group consisting of:

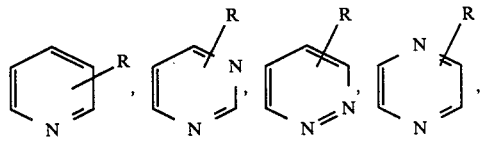

fused ring derivatives thereof and mixtures thereof, wherein R is one or more substituents selected from the group consisting of halogens, methyl cyano, cyano, isocyano, cyanato, isocyanato, thiocyanato, isothiocyanato, nitro, nitroso, formyl, acetyl, methoxy, methyl thio, thiol, disulfide, chloromethyl, dichloromethyl, trichloromethyl, chlorobromomethyl, nitromethyl, cyanomethyl and mixtures thereof.

2. A functional fluid having improved anti-wear properties, said functional fluid comprising:

A. a major amount of a basestock of lubricating viscosity; and

B. a pyridazine compound having one or more substituents thereon, said pyridazine compound being present in an amount sufficient to increase the anti-wear properties of said basestock and wherein the substituents have a dipole moment of at least 0.097 Debyes.

3. The lubricating oil of claim 2 wherein the substituents are selected from the group consisting of chlorine, bromine, chloromethyl, dichloromethyl, trichloromethyl, bromomethyl, dibromomethyl, cyano, isocyano, cyanato, isocyanato, thiocyanato, isothiocyanato, nitro, nitromethyl, nitroso, formyl, acetyl, methyl carboxylate, methoxy, methythio, thiol, disulfide and mixtures thereof.

4. A lubricating oil having improved anti-wear properties comprising a major amount of a basestock of lubricating viscosity and a substituted pyridine compound or fused ring derivative thereof having one or more substituents thereon wherein the substituent has a bond or group moment of at least 3.9 Debyes if the substituent group is in the ortho position and at least 1.42 Debyes if the substituent group is in the meta position where said pyridine compound is present in an amount sufficient to increase the anti-wear properties of said basestock.

5. The lubricating oil of claim 4 wherein the fused ring derivative is quinoline.

6. The lubricating oil of claim 4 wherein the substituents are selected from the group consisting of chlorine, bromine, chloromethyl, dichloromethyl, trichloromethyl, bromomethyl, dibromomethyl, cyano, isocyano, cyanomethyl, cyanato, isocyanato, thiocyanato, isothiocyanato, nitro, nitromethyl, nitroso, formyl, acetyl, methylcarboxylate, methoxy, disulfide, methylthio, thio and mixtures thereof.

7. A lubricating oil having improved anti-wear properties comprising a major amount of a basestock of lubricating viscosity and a pyrazine compound or a fused ring derivative thereof having one or more substituents thereon wherein said substituent has a bond or group moment of at least 1.42 Debyes and wherein said pyrazine or fused ring compound is present in an amount sufficient to increase the anti-wear properties of said basestock.

8. The lubricating oil of claim 7 wherein the substituent is selected from the group consisting of chlorine, bromine, and mixture thereof.

* * * * *